US007419289B2

(12) United States Patent
Yagi

(10) Patent No.: US 7,419,289 B2
(45) Date of Patent: Sep. 2, 2008

(54) VEHICULAR LAMP

(75) Inventor: Takayuki Yagi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/811,470

(22) Filed: Jun. 11, 2007

(65) Prior Publication Data

US 2007/0291501 A1 Dec. 20, 2007

(30) Foreign Application Priority Data

Jun. 16, 2006 (JP) ..... 2006-167749

(51) Int. Cl.
*F21V 33/00* (2006.01)

(52) U.S. Cl. ..... 362/523; 362/285; 362/287; 362/507; 362/516; 362/531; 362/545

(58) Field of Classification Search ..... 362/285, 362/287, 543, 544, 545, 507, 508, 523, 524, 362/531, 516
See application file for complete search history.

(56) References Cited

U.S. PATENT DOCUMENTS 5,050,044 A * 9/1991 Shibayama ..... 362/18
6,851,843 B2 * 2/2005 Muller et al. ..... 362/555
2002/0057578 A1 * 5/2002 Kageyama et al. ..... 362/544
2002/0064054 A1 * 5/2002 Sugimoto et al. ..... 362/523

FOREIGN PATENT DOCUMENTS

JP 2003-31011 1/2003

OTHER PUBLICATIONS

English Abstract of JP2003031011 published Jan. 31, 2003 from the esp@cenet database-Worldwide, 1 page.

* cited by examiner

*Primary Examiner*—Laura Tso
(74) *Attorney, Agent, or Firm*—Osha Liang, LLP

(57) ABSTRACT

A lamp unit includes a semiconductor light-emitting element portion, a reflector that radiates light from a light source forward of the lamp, and a driving portion that moves relative positions of the semiconductor light-emitting element portion and the reflector. The semiconductor light-emitting element portion is provided with a light-emitting surface whose outer peripheral shape is generally oblong, the reflector is provided with a parabolic surface that has a focus line in the horizontal direction, and the driving portion is configured such that rotation is possible within a horizontal plane of the light-emitting surface from a first position where a short side of the light-emitting surface is generally parallel to the focus line up to a second position where a long side of the light-emitting surface is generally parallel to the focus line.

7 Claims, 12 Drawing Sheets

ROTATION ANGLE = 0°

ROTATION ANGLE = 90°

ROTATION ANGEL = 40°

ROTATION ANGLE = 60°

ROTATION ANGLE =80°

VEHICULAR LAMP

BACKGROUND OF INVENTION

1. Field of the Invention

The present invention relates to a vehicular lamp.

2. Background Art

Depending on the driving situation, a vehicular lamp (headlamp) is expected to have two light distribution patterns: a pattern in which diffused light is distributed in front of the vehicle and partially condensed light is weakened; and a pattern in which less diffused light is distributed to the front of the vehicle and localized condensed light is strengthened, such that a clear boundary appears between an irradiated portion and a non-irradiated portion. Especially in times of rain or the like, a distribution pattern with lowered illumination intensity toward a vehicle front side is effective. The difference between the two light distribution patterns lies in the intensity of the condensed light and the vertical-direction expansion of the light distribution patterns.

Many vehicular lamps that use a semiconductor light-emitting element as a light source have been developed in recent years. An LED chip used as a light source normally has a light-emitting surface with a generally oblong shape. The LED chip is disposed so as to coincide with a focus line of a reflective surface formed from a curved surface or the like whose light-emitting surface has one side end with a parabolic and cylindrical shape (see Patent Document 1 for an example).

[Patent Document 1] Japanese Patent Application Publication No. JP-A-2003-31011.

In order to realize the two light distribution patterns described above, the conventional vehicular lamps include a unit that combined a plurality of headlamps.

SUMMARY OF INVENTION

One or more embodiments of the present invention provide a vehicular lamp capable of changing an intensity of condensed light and a vertical-direction expansion of a light distribution pattern.

One or more embodiments of the present invention relate to a vehicular lamp provided with a light source, a reflector that radiates light from the light source forward of the lamp, and driving means that moves relative positions of the light source and the reflector, wherein the light source is provided with a light-emitting surface whose outer peripheral shape is generally oblong, the reflector is provided with a parabolic surface that has a focus line in the horizontal direction, and the driving means is structured such that rotation is possible within a horizontal plane of the light-emitting surface from a first position where a short side of the light-emitting surface is generally parallel to the focus line up to a second position where a long side of the light-emitting surface is generally parallel to the focus line. According to such a configuration, rotating the generally oblong light source enables an increase in a component of light advancing directly forward, and suppression of a component of light advancing forward and downward. Thus, it is possible to change an intensity of condensed light and a vertical-direction expansion of a light distribution pattern.

Furthermore, one or more embodiments of the present invention relate to a vehicular lamp provided with a light source, and a reflector that radiates light from the light source forward of the lamp, wherein the reflector is provided with a parabolic surface that has a focus line in the horizontal direction, and the light source is structured such that a unitary light source, which is provided with a light-emitting surface whose outer peripheral shape is generally oblong, is disposed at a first position where a short side of the light-emitting surface is generally parallel to the focus line and at a second position where a long side of the light-emitting surface is generally parallel to the focus line, so as to have one of a general L-shape and a general T-shape as a light source shape. According to such a configuration, light is selectively emitted from either a portion of the light source disposed in a general L-shape or a general T-shape at the first position or the second position. Therefore, a component of light advancing directly forward can be increased, and a component of light advancing forward and downward can be suppressed. Thus, it is possible to change an intensity of condensed light and a vertical-direction expansion of a light distribution pattern.

According to one or more embodiments of the present invention, a component of light advancing directly forward can be increased, and a component of light advancing forward and downward can be suppressed. Thus, it is possible to change an intensity of condensed light and a vertical-direction expansion of a light distribution pattern.

Other aspects and advantages of the invention will be apparent from the following description and the appended claims.

DETAILED DESCRIPTION

Figure 1:
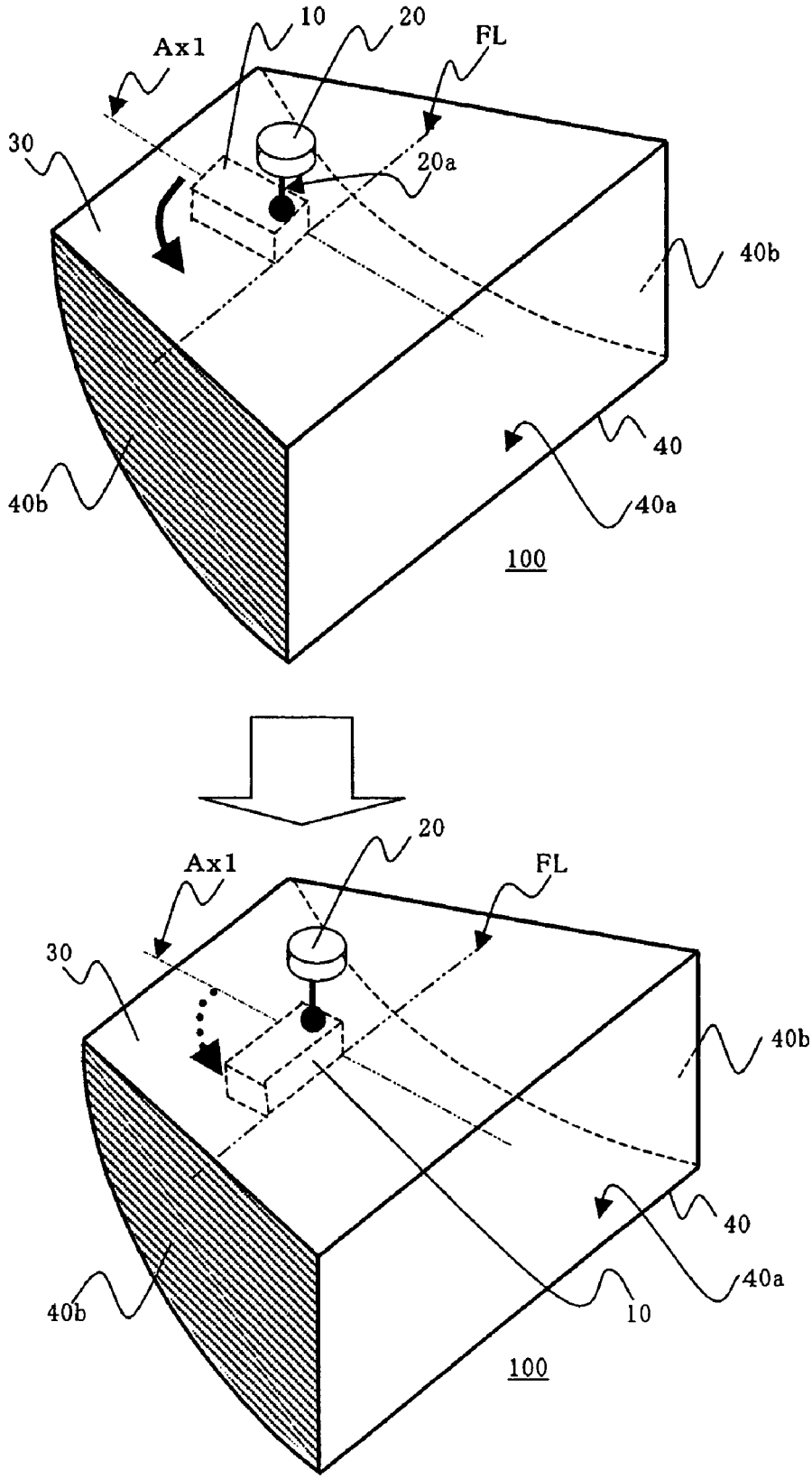
FIG. 1 is a schematic diagram of a configuration of a vehicular lamp according to an embodiment of the present invention.

FIG. 1 is a schematic diagram of a configuration of a vehicular lamp according to an embodiment of the present invention. A vehicular lamp unit 100 is provided with a semiconductor light-emitting element portion 10 that constitutes a light source, a driving portion 20 that rotates the semiconductor light-emitting element portion 10 within a horizontal plane, a support bracket 30 that fixes the driving portion 20 and also functions as a light-controlling member, and a reflector 40 that is disposed on a downward side of the support bracket 30.

The reflector 40 has a reflective surface 40*a*, which is formed from a curved surface with a parabolic and cylindrical shape and has a focus line FL that extends in the horizontal direction. Both sides of the reflective surface 40*a* are formed with a pair of side walls 40*b*. In such case, the focus line FL is set so as to extend in a direction orthogonal to a unit center axis Ax1 of the lamp unit 100. The unit center axis Ax1 is an axis of a parabola that constitutes a vertical cross section of the parabolic and cylindrical surface. The pair of side walls 40*b* has a symmetrical shape with respect to the unit center axis Ax1, and the side walls 40*b* are formed as vertical walls that broaden in the forward direction.

Figure 2:
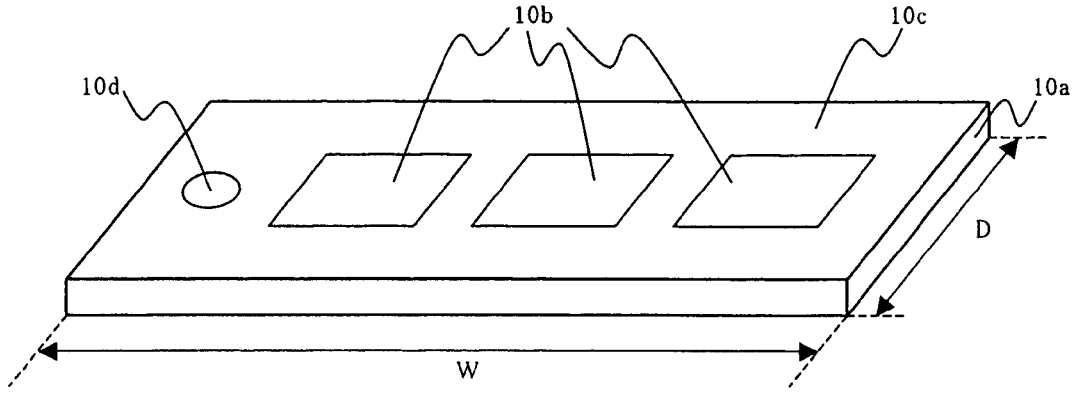
FIG. 2 is a view showing in detail a configuration of a semiconductor light-emitting element of a vehicular lamp according to an embodiment of the present invention.

FIG. 2 is a view showing in detail a configuration of a semiconductor light-emitting element of a vehicular lamp according to an embodiment of the present invention. The semiconductor light-emitting element portion 10 is formed so as to constitute a light-emitting surface, where a plurality of white light-emitting diodes 10*b* having light-emitting chips such as LEDs are disposed on a substrate 10*a*. In the semiconductor light-emitting element portion 10, an end 10*d* of the light-emitting surface 10*c* is held by a tip of a rotation axis 20*a* of the driving portion 20 such that the light-emitting surface 10*c* faces vertically downward. The semiconductor light-emitting element portion 10 is thus rotatable in a 90° range from a position where a short side D of the generally oblong light-emitting surface 10*c* coincides with the focus line FL to a position where a long side W coincides with the focus line of the reflective curved surface. Further details regarding the rotation range of the light-emitting surface 10*c* will be given later.

The driving portion 20 is constituted by a drive part such as a motor, and is fixed on the support bracket 30. The rotation axis 20*a* is inserted into a hole portion formed in the support bracket 30. As mentioned above, the tip of the rotation axis 20*a* is held by an end 10*d* of the semiconductor light-emitting element portion 10. Therefore, it is possible to transmit the rotation force of the driving portion 20 and rotate the semiconductor light-emitting element portion 10 within a horizontal plane.

Figure 3A:
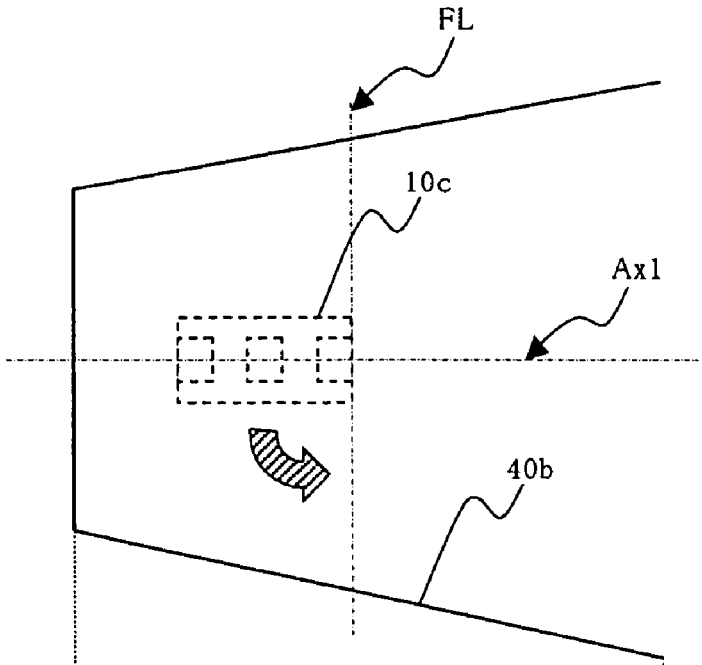
FIG. 3 shows schematic diagrams for describing how the semiconductor light-emitting element is rotated by a driving portion of the vehicular lamp according to an embodiment of the present invention (in a first position).
Figure 3B:
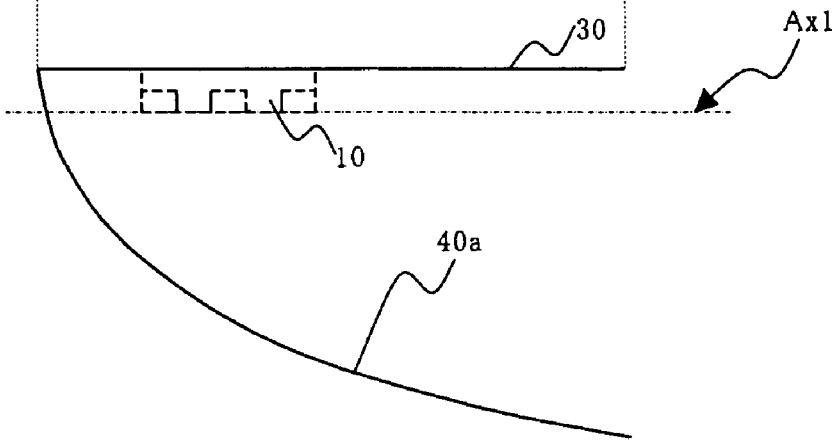
Figure 4A:
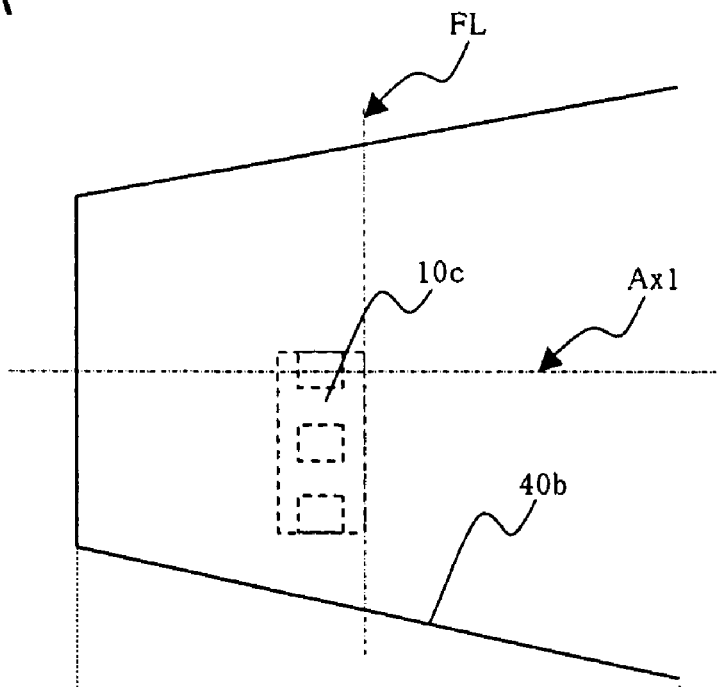
FIG. 4 shows schematic diagrams for describing how the semiconductor light-emitting element is rotated by a driving portion of the vehicular lamp according to an embodiment of the present invention (in a second position).
Figure 4B:
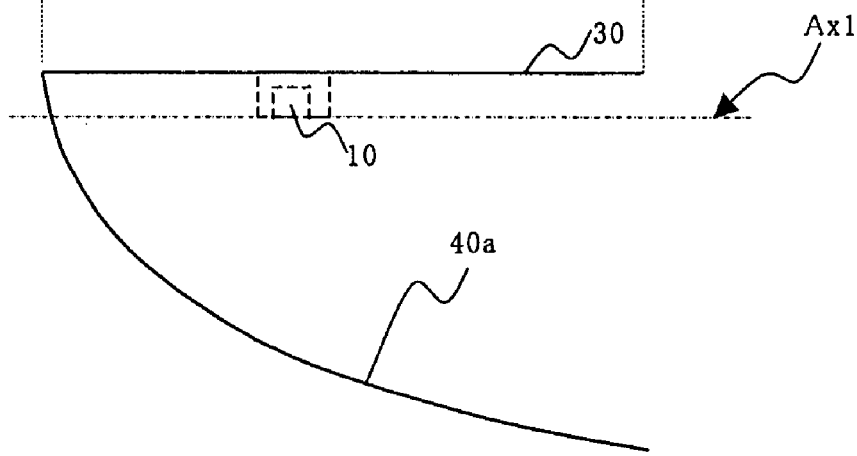

FIGS. 3 and 4 are schematic diagrams showing how the semiconductor light-emitting element is rotated by the driving portion of the vehicular lamp according to an embodiment of the present invention. Note that for the sake of convenience, the driving portion 20 is omitted from the figures. Normally, the semiconductor light-emitting element portion 10 is positioned, as shown by an overhead view in FIG. 3(*a*), such that the short side D thereof coincides with the focus line FL and the long side W is disposed along the unit center axis Ax1. The light-emitting surface extends, as shown by a vertical cross-sectional view in FIG. 3(*b*), from the vicinity of an intersection point between the unit center axis Ax1 and the focus line FL toward the rear of the lamp. Hereinafter, such an arrangement of the semiconductor light-emitting element portion 10 as described above will be referred to as a "first position".

Meanwhile, if the semiconductor light-emitting element portion 10 is rotated approximately 90° in the counter-clockwise direction due to rotation of the driving portion 20, as shown by an overhead view in FIG. 4(*a*), the long side W of the semiconductor light-emitting element portion 10 coincides with the focus line FL, and moves from the vicinity of the intersection point between the unit center axis Ax1 and the focus line FL to a position disposed along the focus line. The light-emitting surface, as shown by a vertical cross-sectional view in FIG. 4(*b*), extends in the vicinity of the focus line FL along the focus line, with little expansion in the direction of the unit center axis Ax1. Hereinafter, such an arrangement of the semiconductor light-emitting element portion 10 as described above will be referred to as a "second position". Expressed as a rotation angle from a reference position that uses the first position as the reference, the second position is a 90° position.

Figure 5:
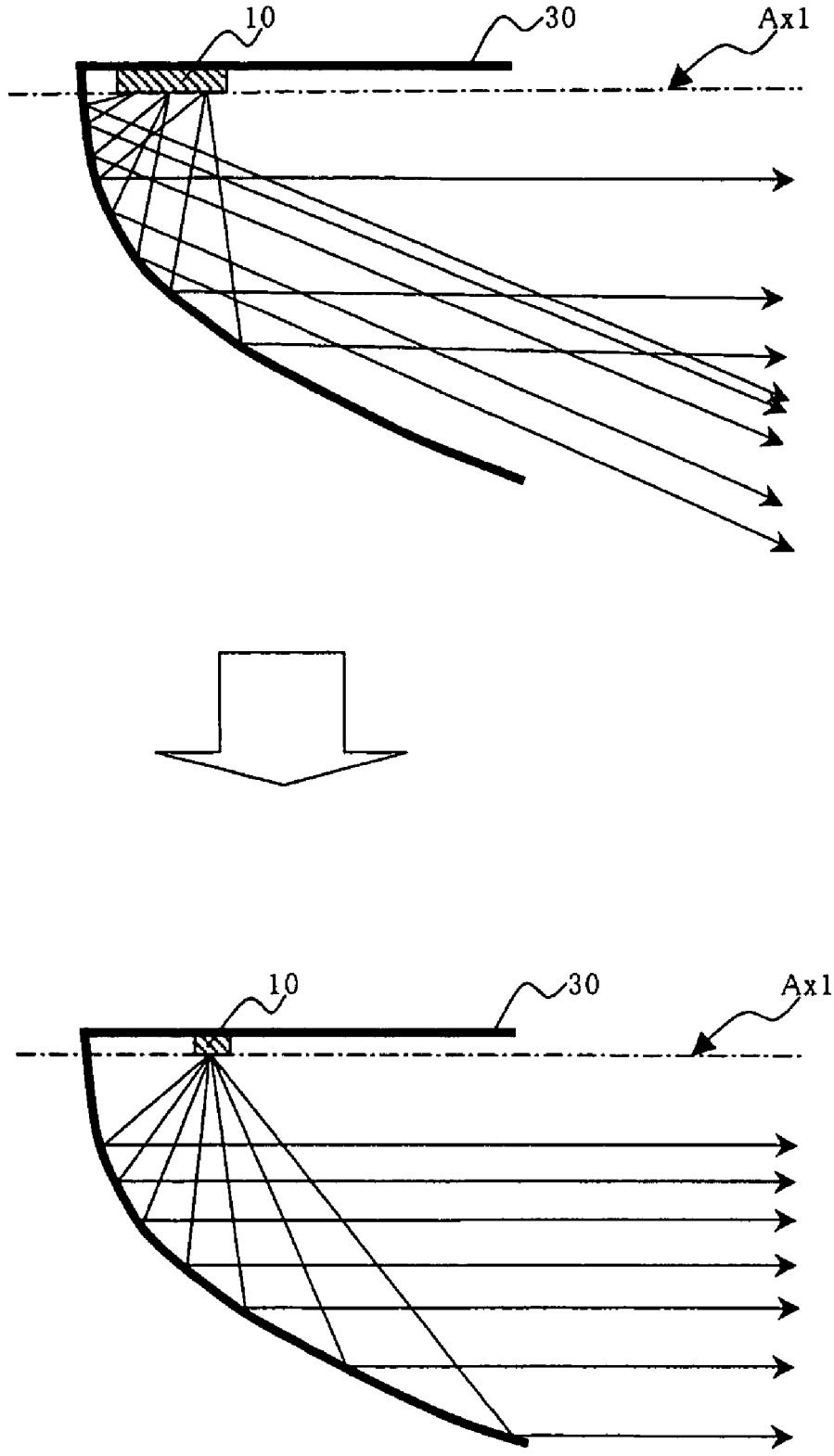
FIG. 5 is a schematic diagram for describing a change in a light path due to the rotation of the semiconductor light-emitting element portion.

FIG. 5 is a schematic diagram for describing a change in a light path due to the rotation of the semiconductor light-emitting element portion. As FIG. 5 shows, when lighting at the first position, there is a light path advancing immediately forward and downward of the lamp, in addition to light directly advancing in the forward direction of the lamp parallel to the unit center axis Ax1. Accordingly, it is possible to irradiate a relatively broad range.

Figure 6:
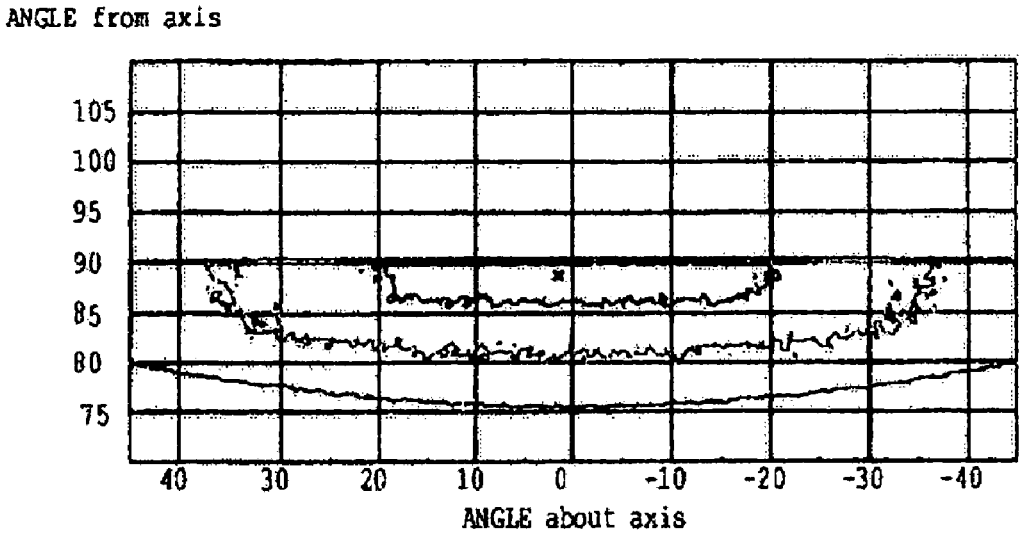
FIG. 6 is a schematic diagram showing a light distribution pattern at the first position, where a short side of a light-emitting surface is generally parallel to a focus line, of the vehicular lamp according to an embodiment of the present invention.

FIG. 6 is a schematic diagram showing a light distribution pattern at the first position (at a 0° rotation angle), where the short side of the light-emitting surface is generally parallel to the focus line, of the vehicular lamp according to an embodiment of the present invention. As FIG. 6 shows, diffused light is radiated in front of the vehicle, and the intensity of condensed light is weak.

Meanwhile, when lighting at the second position after rotating the semiconductor light-emitting element portion 10, the light-emitting surface is concentrated in the vicinity of the focus line FL. Therefore, light directly advancing in the forward direction of the lamp parallel to the unit center axis Ax1 is condensed. Accordingly, it is possible to irradiate a relatively narrow range in a concentrated manner.

Figure 7:
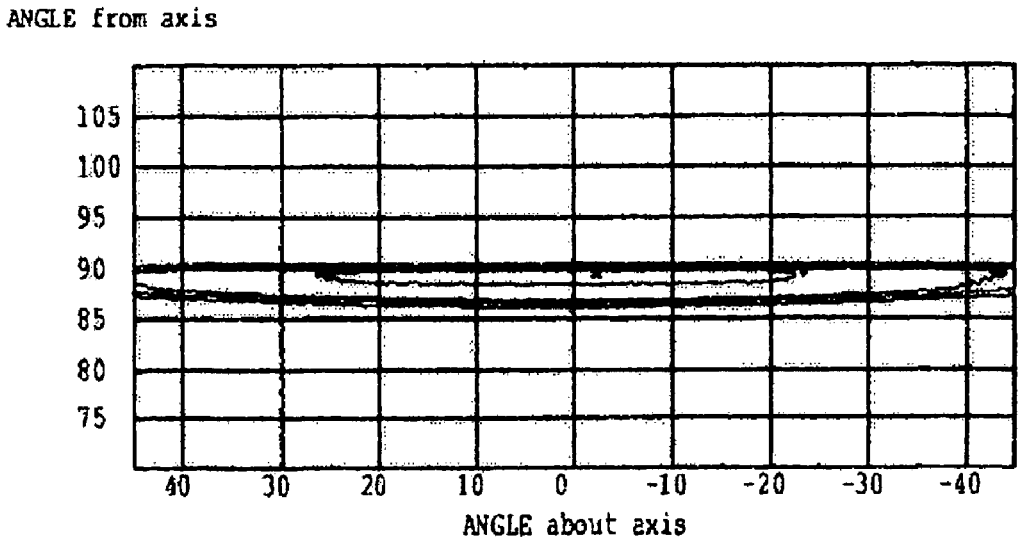
FIG. 7 is a schematic diagram showing a light distribution pattern at the second position, where a long side of the light-emitting surface is generally parallel to the focus line, of the vehicular lamp according to an embodiment of the present invention.

FIG. 7 is a schematic diagram showing a light distribution pattern at the second position (at a 90° rotation angle), where the long side of the light-emitting surface is generally parallel to the focus line, of the vehicular lamp according to an embodiment of the present invention. As FIG. 7 shows, diffused light at the front of the vehicle is reduced, and condensed light forward of the vehicle is strengthened.

Figure 8:
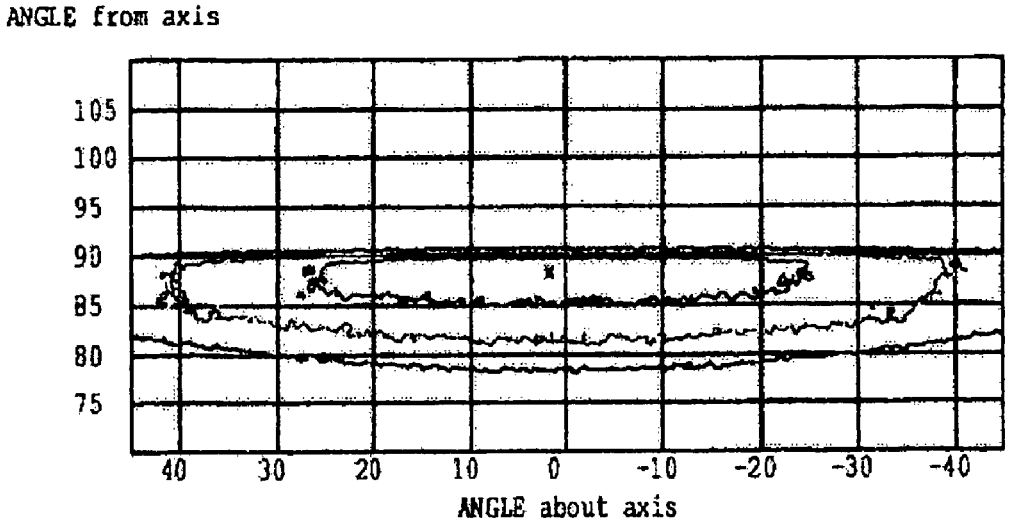
FIG. 8 is a schematic diagram showing a light distribution pattern, when the semiconductor light-emitting element is at a 40° rotation angle, of a vehicular lamp according to an embodiment of the present invention.
Figure 9:
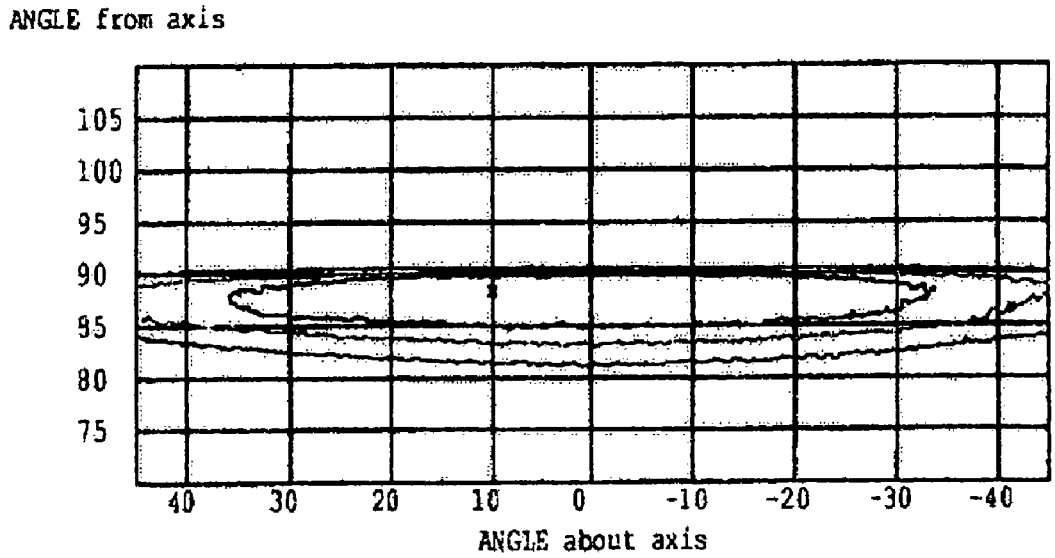
FIG. 9 is a schematic diagram showing a light distribution pattern, when the semiconductor light-emitting element is at a 60° rotation angle, of a vehicular lamp according to an embodiment of the present invention.
Figure 10:
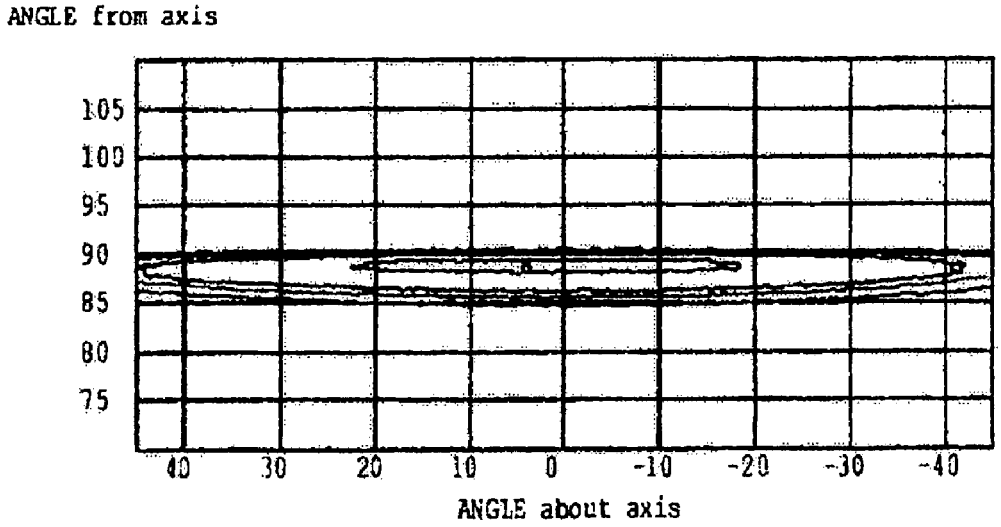
FIG. 10 is a schematic diagram showing a light distribution pattern, when the semiconductor light-emitting element is at an 80° rotation angle, of a vehicular lamp according to an embodiment of the present invention.

Note that the rotation angle achieved by the driving portion 20 is not particularly limited to 0° and 90°, and it is possible to stop at an arbitrary angle from 0° to 90°. For example, FIGS. 8 to 10 are schematic diagrams showing light distribution patterns, when the semiconductor light-emitting element is at a 40°, 60°, and 80° rotation angle, of a vehicular lamp according to embodiments of the present invention. As the figures show, it is clear that the light distribution pattern gradually changes from 0° to 90°.

During rotation, there is no sudden change in the irradiation state that the eyes of a driver of the vehicle would be incapable of following. Therefore, there is no risk of an unsafe state generated by rotation of the semiconductor light-emitting element portion during driving. As a consequence, it is possible to allow the driver to select a light distribution pattern at an arbitrary angle depending on outside weather conditions, driving circumstances or the like, by operating the driving portion while driving. In addition, the rotation angle may be automatically set after determining various conditions such as a level of brightness outside the vehicle.

Note that in the above embodiments, an example using a motor as the driving portion 20 was described. However, the present invention is not particularly limited to this case, and any means may be used provided that the means is an actuator or the like enabling rotation of the semiconductor light-emitting element portion 10.

Figure 11:
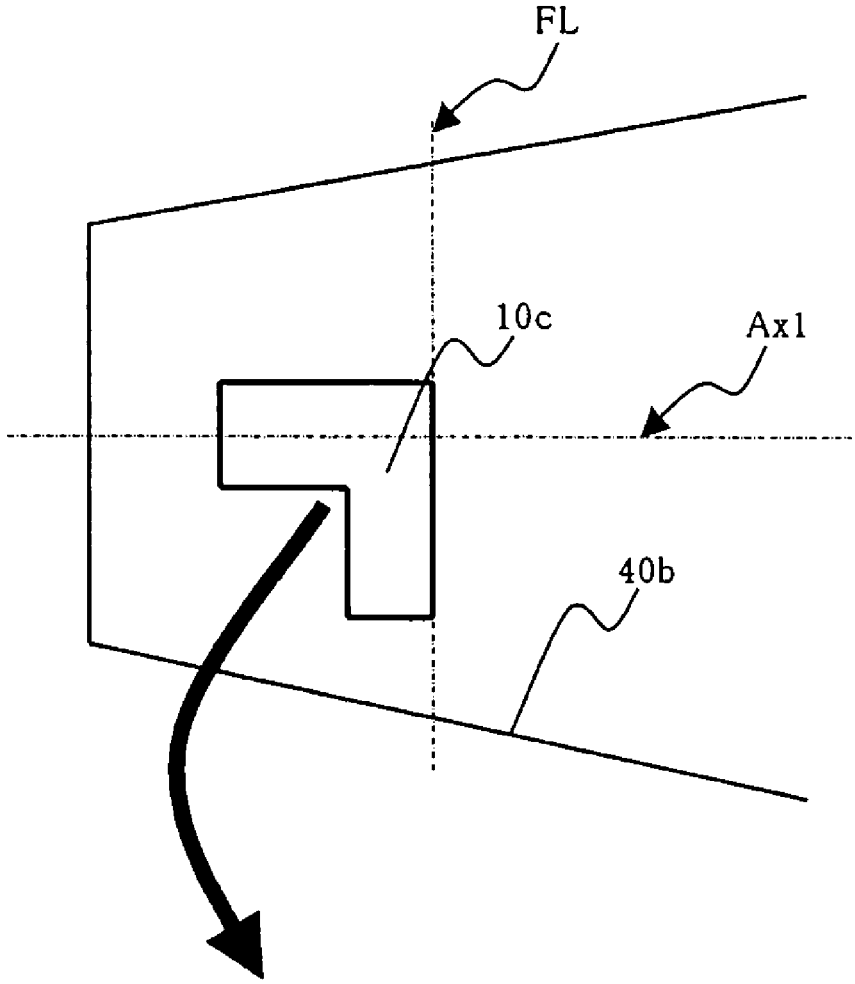
FIG. 11 shows schematic diagrams illustrating a configuration of a vehicular lamp when the light-emitting surface of the semiconductor light-emitting element is L-shaped.
Figure 11A:
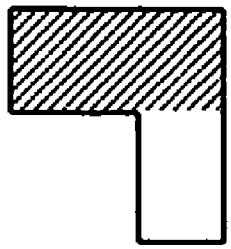
Figure 11B:
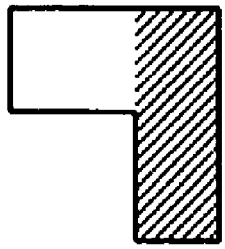

FIGS. 11 are schematic diagrams showing a configuration of the vehicular lamp when the light-emitting surface of the semiconductor light-emitting element is L-shaped. Provided that LED chips or the like are suitably arranged so as to form an L-shaped light-emitting surface as shown in the figures, it is possible to selectively realize light emission at the first position (FIG. 11(*a*)) and light emission at the second position (FIG. 11(*b*)) without providing the driving portion 20. Thus, an effect similar to the above embodiments can be obtained. However, because the driving portion is unnecessary in such an embodiment, a space-saving type of vehicular lamp can be achieved.

Figure 12:
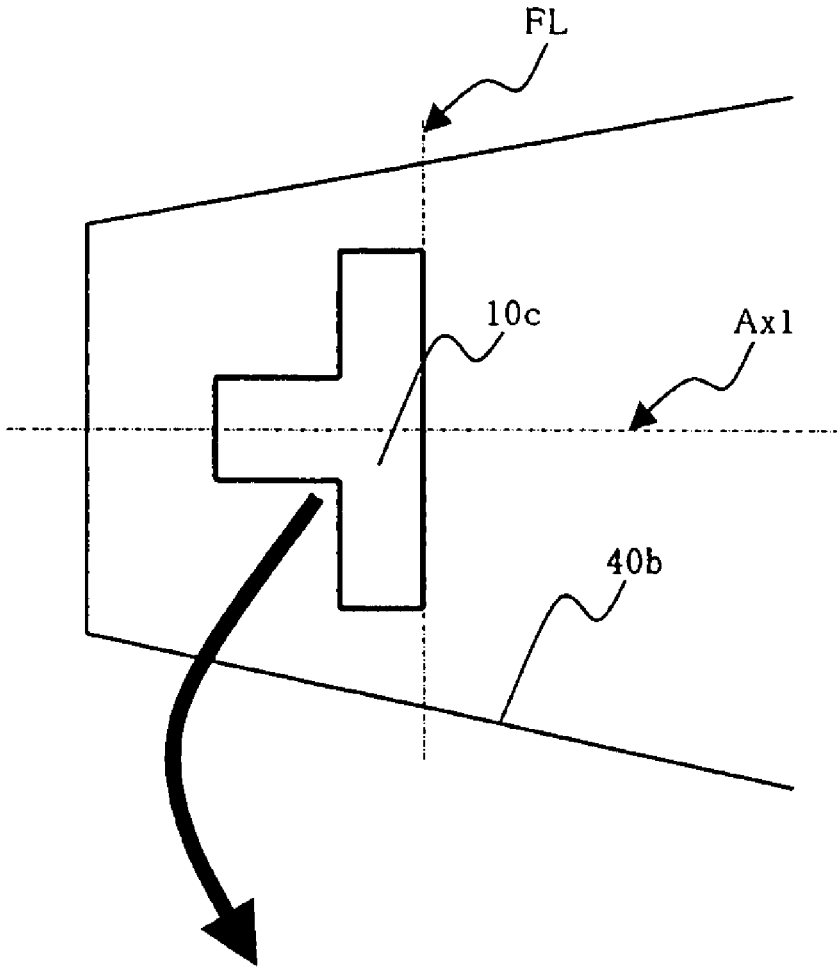
FIG. 12 shows schematic diagrams illustrating a configuration of a vehicular lamp when the light-emitting surface of the semiconductor light-emitting element is T-shaped.
Figure 12A:
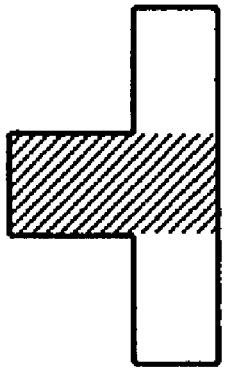
Figure 12B:
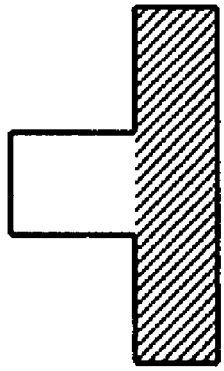

FIGS. 12 are schematic diagrams showing a configuration of the vehicular lamp when the light-emitting surface of the semiconductor light-emitting element is T-shaped. Provided that LED chips or the like are suitably arranged so as to form a T-shaped light-emitting surface as shown in the figures, it is possible to selectively realize light emission at the first position (FIG. 12(*a*)) and light emission at the second position (FIG. 12(*b*)) without providing the driving portion 20. Thus, an effect similar to the above embodiments can be obtained. However, because the driving portion is unnecessary in such an embodiment, a space-saving type of vehicular lamp can be achieved.

According to the above embodiments, it is possible to arbitrarily change the light distribution pattern of one lamp without disposing a plurality of lamps with different light distribution patterns. By changing the intensity of the condensed light and the vertical-direction expansion of the light distribution pattern, it is possible to lower illumination intensity toward a vehicle front side especially in times of rain or the like, and thus reduce glare.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

Description of the Reference Numerals

10 SEMICONDUCTOR LIGHT-EMITTING ELEMENT PORTION
10*a* SUBSTRATE
10*b* WHITE LIGHT-EMITTING DIODE
10*c* LIGHT-EMITTING SURFACE
20 DRIVING PORTION
20*a* ROTATION AXIS
30 SUPPORT BRACKET
40 REFLECTOR
40*a* REFLECTIVE SURFACE
40*b* SIDE WALL
100 LAMP UNIT
Ax1 UNIT CENTER AXIS
FL FOCUS LINE

What is claimed is:

1. A vehicular lamp comprising:
a light source,
a reflector that reflects light radiated from the light source forward of the lamp, and
driving means that moves relative positions of the light source and the reflector, wherein
the light source comprises a light-emitting surface whose outer peripheral shape is generally oblong,
the reflector comprises a parabolic surface that has a focus line in the horizontal direction, and
the driving means is configured such that rotation is possible within a horizontal plane of the light-emitting surface from a first position where a short side of the light-emitting surface is generally parallel to the focus line to a second position where a long side of the light-emitting surface is generally parallel to the focus line.

2. The vehicular lamp according to claim 1, wherein the light source is a semiconductor light-emitting element.

3. A vehicular lamp comprising:
a light source, and
a reflector that reflects light radiated from the light source forward of the lamp, wherein
the reflector comprises a parabolic surface that has a focus line in the horizontal direction, and
the light source is structured configured such that a unitary light source, which is provided with a light-emitting surface whose outer peripheral shape is generally oblong, is disposed at a first position where a short side of the light-emitting surface is generally parallel to the focus line and at a second position where a long side of the light-emitting surface is generally parallel to the focus line.

4. The vehicular lamp according to claim 3, wherein the light source is a semiconductor light-emitting element.

5. The vehicular lamp according to claim 3, wherein the light source has one of a general L-shape or a general T-shape.

6. A vehicular lamp comprising:
a light source comprising a light-emitting surface whose outer peripheral shape is generally oblong,
a reflector that reflects light radiated from the light source forward of the lamp, the reflector comprising a parabolic surface having a focus line in the horizontal direction, and
a driving portion that moves relative positions of the light source and the reflector,
wherein the driving portion is configured such that rotation is possible within a horizontal
plane of the light-emitting surface from a first position where a short side of the light-emitting surface is generally parallel to the focus line to a second position where a long side of the light-emitting surface is generally parallel to the focus line.

7. The vehicular lamp according to claim 6, wherein the light source is a semiconductor light-emitting element.

* * * * *